US011420088B2

(12) United States Patent
Wilson

(10) Patent No.: US 11,420,088 B2
(45) Date of Patent: Aug. 23, 2022

(54) EXERCISE SYSTEM FOR EXERCISING OBLIQUE MUSCLES AND METHOD OF USING THE SYSTEM

(71) Applicant: Karina Wilson, Westbury, NY (US)

(72) Inventor: Karina Wilson, Westbury, NY (US)

( * ) Notice: Subject to any disclaimer, the term of this patent is extended or adjusted under 35 U.S.C. 154(b) by 0 days.

(21) Appl. No.: 16/845,290

(22) Filed: Apr. 10, 2020

(65) Prior Publication Data

US 2020/0324160 A1 Oct. 15, 2020

Related U.S. Application Data

(60) Provisional application No. 62/832,990, filed on Apr. 12, 2019.

(51) Int. Cl.
*A63B 21/06* (2006.01)
*A63B 21/062* (2006.01)
(Continued)

(52) U.S. Cl.
CPC ..... *A63B 21/0615* (2013.01); *A63B 21/023* (2013.01); *A63B 21/0407* (2013.01);
(Continued)

(58) Field of Classification Search
CPC ..... A63B 21/0615; A63B 21/063; A63B 21/4035; A63B 21/023; A63B 21/154;
(Continued)

(56) References Cited

U.S. PATENT DOCUMENTS 4,337,050 A * 6/1982 Engalitcheff, Jr. .. A63B 21/015 434/219
4,390,179 A * 6/1983 Szkalak ..... A63B 21/154 482/100

(Continued)

FOREIGN PATENT DOCUMENTS

GB 302467 A * 12/1928 ..... A63B 21/4035

OTHER PUBLICATIONS

Screenshots from YouTube Video titled "Outdoor gym equipment—Big Shoulder Wheel", uploaded on Jun. 16, 2010 by user "outdorrexercise", 5 pages, retrieved from Internet: https://www.youtube.com/watch?v=kjADvNr2kGc (Year: 2010).*

*Primary Examiner* — Garrett K Atkinson
*Assistant Examiner* — Kathleen M Fisk
(74) *Attorney, Agent, or Firm* — John F. Vodopia

(57) ABSTRACT

An exercise system for exercising a body's oblique muscle group relies upon a wheel mechanism having an outer wheel portion arranged at a first radial distance and an inner wheel portion arranged at a second radial distance, where the outer and inner wheel parts include respective sets of handgrips. A weight system is arranged to be coupled to and decoupled from the wheel mechanism. A coupling mechanism couples the weight system to and decouples the weight system from the wheel mechanism, in a first circumferential direction, or in a second circumferential direction. The hand grips allow a user to grasp the wheel mechanism and turn it in the first or the second circumferential directions against a respective force that the wheel mechanism is turned against that is defined by the aggregate selected weight when coupled to the wheel mechanism, in one of the first and second circumferential directions.

15 Claims, 6 Drawing Sheets

(51) Int. Cl.

| | |
|---|---|
| ***A63B 21/22*** | (2006.01) |
| ***A63B 21/00*** | (2006.01) |
| ***A63B 21/04*** | (2006.01) |
| ***A63B 23/02*** | (2006.01) |
| ***A63B 21/02*** | (2006.01) |
| ***A63B 21/055*** | (2006.01) |

(52) U.S. Cl.
CPC ..... *A63B 21/0552* (2013.01); *A63B 21/063* (2015.10); *A63B 21/154* (2013.01); *A63B 21/157* (2013.01); *A63B 21/22* (2013.01); *A63B 21/4035* (2015.10); *A63B 23/0205* (2013.01)

(58) Field of Classification Search
CPC ..... A63B 21/0407; A63B 21/157; A63B 21/0552; A63B 23/0205; A63B 23/03533; A63B 23/0227; A63B 21/0628; A63B 21/4049; A63B 2225/093; A63B 9/00; A63B 2009/006; A63B 19/00; A63B 19/04; A63B 21/062; A63B 21/0624; A63B 21/0626; A63B 21/0632; A63B 21/22–222; A63B 21/227; A63B 2023/003; A63B 2023/006; A63B 23/1245
See application file for complete search history.

(56) References Cited

U.S. PATENT DOCUMENTS

| | | | | |
|---|---|---|---|---|
| 4,772,015 | A * | 9/1988 | Carlson | A63B 23/12 482/902 |
| 4,988,098 | A * | 1/1991 | Miller | A63B 23/1245 482/99 |
| 5,031,912 | A * | 7/1991 | Vaughn | A63B 23/12 482/118 |
| 7,331,908 | B2 * | 2/2008 | Olsen | A63B 21/0628 482/101 |
| 7,753,827 | B1 * | 7/2010 | Emick | A63B 23/14 482/44 |
| 9,272,176 | B1 * | 3/2016 | Bendror | A63B 21/4035 |
| 2004/0033868 | A1 * | 2/2004 | Van Straaten | A63B 22/0005 482/110 |
| 2007/0093363 | A1 * | 4/2007 | Sharps | A63B 21/4049 482/94 |
| 2008/0081745 | A1 * | 4/2008 | Sargen | A63B 23/03558 482/98 |
| 2019/0314669 | A1 * | 10/2019 | Hernandez | A63B 21/4049 |

* cited by examiner

EXERCISE SYSTEM FOR EXERCISING OBLIQUE MUSCLES AND METHOD OF USING THE SYSTEM

BACKGROUND OF THE INVENTION

The invention broadly relates to exercise apparatus and, relates more particularly to an exercise system designed for exercising the body's oblique muscle group and method of exercising the oblique muscles through use of the inventive system. The system and method rely on a wheel-shaped mechanism that is coupled to a weight system. The user grips and drives the wheel-shaped mechanism, which causes a fixed weight to be concomitantly moved, preferably repetitiously, thereby exercising one or the other of the users oblique muscle group.

Wheel-based mechanisms, such as drive mechanisms also are known. U.S. Pat. No. 5,031,912, for example, discloses an automobile steering assembly for mounting on a wheelchair for therapeutic purposes. FIG. 1 presents a side view of the wheelchair 10. The wheelchair includes plate 20 and steering wheel 12 mounted on the plate with a shaft 2. Shaft 22 has one end-threaded and a cap-shaped knob 23. Friction clutch plate 25 lies next to the spacer ring 24. With the steering wheel mounted on plate 20, the wheel can turn or rotate about its axis on shaft 22. Manually turning of knob 23 clockwise tends to cause Belleville spring 30 to flex and increase the friction between the clutch plates 25 and 27 and the opposite faces of steering wheel hub 12c. The manual turning of knob 23 clockwise or counterclockwise will permit adjusting the tension in the hub and thereby change the force.

Frequently adjusting changing the force can be tiresome. Also, adjusting and readjusting increases chance of error.

SUMMARY OF THE INVENTION

The present invention overcomes the shortcomings of the prior art.

In an embodiment, the invention provides an exercise system for exercising a body's oblique muscle group. The exercise system comprises a wheel mechanism comprising an outer wheel portion arranged at a first radial distance from a geometric center of the wheel mechanism and an inner wheel portion arranged at a second radial distance from the geometric center of the wheel mechanism, where first radial distance is greater than the second radial distance, a weight system and a coupling mechanism for coupling the weight system to the wheel mechanism.

The outer and the inner wheel portions are arranged to enable a user to comfortably grasp or grip the outer wheel portion, the inner wheel portion, or both, and turn in a first or a second circumferential direction against a respective force or weight defined by the weight system. At least one handgrip is provided on the outer wheel portion, the inner wheel portion or both. The weight system is configured to enable a user to set a weight to define the weight or force against which the wheel mechanism is turned. Preferably, the weight system includes multiple weight elements, and a selection mechanism for selecting a subset of weight elements, thereby setting the weight or force.

The coupling mechanism preferably comprises a cable, a pulley on an axle and a quick detach pin that allows a user to define one of the first and the second differential directions. The cable is connected to the wheel mechanism. For that matter, the coupling mechanism comprises any of cords, a chain, elastic bands, rubber bands, springs, a gear system and a clutch-based system. An amount of challenging force a user must apply to turn the wheel mechanism in either the first or the second circumferential direction varies with the radial distance to a position on the inner or outer wheel portions, from the geometric center. Alternatively, an amount of challenging force a user must apply to the inner wheel portion is greater than an amount of challenging, force the user must apply to the outer wheel portion.

Also, at least one handgrip is included on the inner wheel portion and at least one handgrip is included on the outer wheel portion. For that matter, the wheel mechanism, other than the handgrips, which are made of plastic or rubber, the weight system and the coupling mechanism are made of metal. A base or main support system upon which the wheel mechanism and weight system are arranged for support.

BRIEF DESCRIPTION OF THE DRAWINGS

The invention will be described in conjunction with the following drawings in which like reference numerals designate like elements and wherein.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
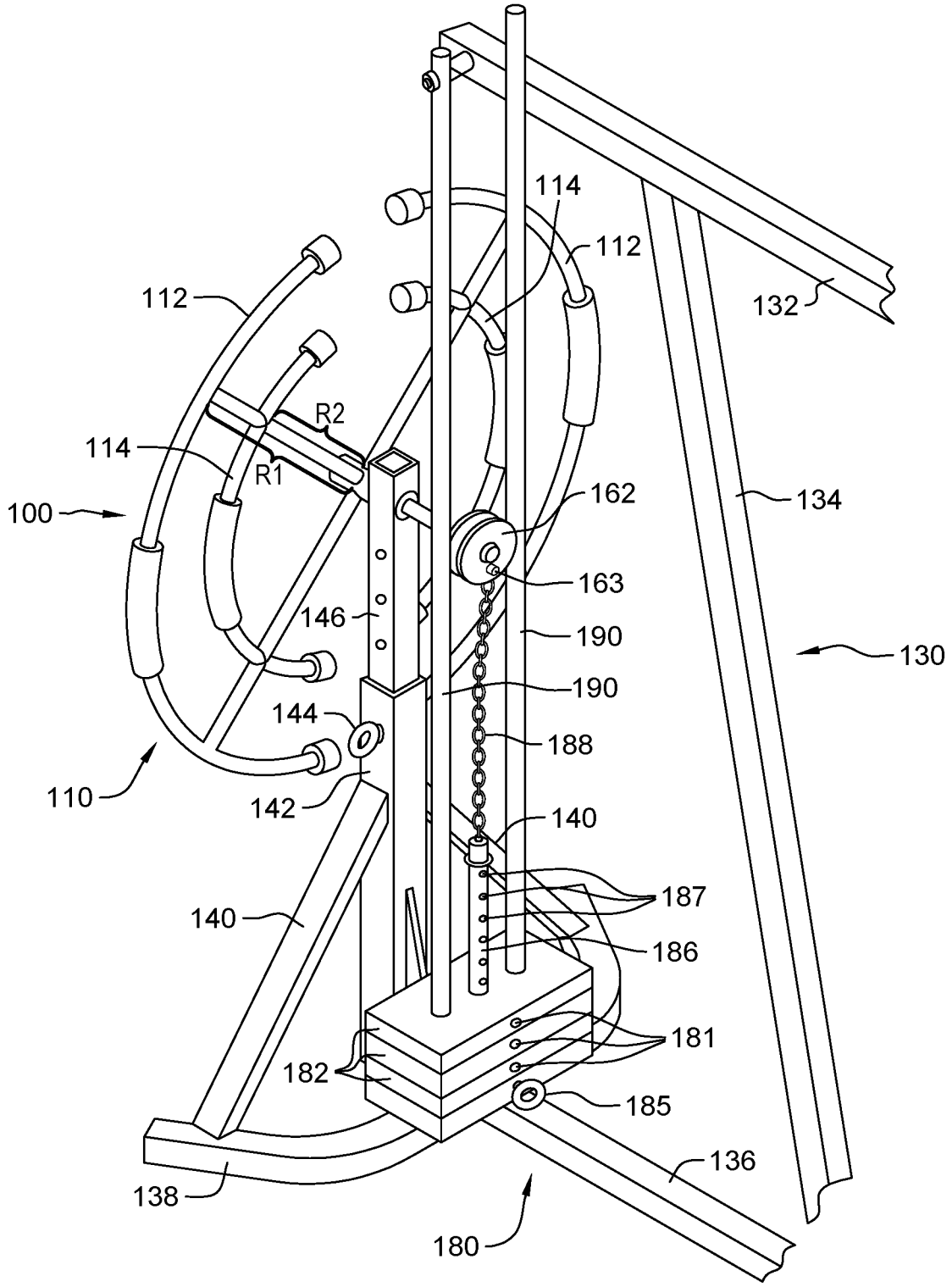
FIG. 1 presents a rear perspective view of a first embodiment of an inventive exercise system for exercising a body's oblique muscle group, according to the inventive principles.

One embodiment of an exercise system 100 constructed in accordance with the invention is depicted in FIG. 1. The exercise system is for exercising a body's oblique muscle group. The exercise system includes a wheel mechanism 110 comprising an outer wheel portion 112 arranged at a first radial distance R1 from a geometric center (○) of the wheel mechanism 110 and an inner wheel portion 114 arranged at a second radial distance R2 from the geometric center (○) (FIG. 2) of the wheel mechanism 110, where first radial distance R1 is greater than the second radial distance R2. For example, R1 might be 36 inches where R2 is 24 inches.

The exercise system 100 includes a base or main support system 130. The base or support system includes various structural elements, such as top element 132, vertical element 134, straight base element 136, support base element 138, bracket elements 140, outer slide member 142, which cooperates with telescoping inner slider 146, and which is "set" in reliance upon key 144. The key 144 allows adjustment of the amount of inner slider 146, which extends from the opening of the outer sliding member 142. An axle 160 passes through the inner slider 146 and connects to the wheel mechanism 110 on one end, and connects to a pulley 162 on its other end.

A weight system 180 is arranged on the base or main support system 130. The weight system includes weights 182 that form part of a set that defines the weight used for exercising. A central separator 186 is contacted with a key 185 that slips through a hole 181 in the weights 182 and that fits in opening 187 in the outer cylindrical surface of the central separator 186. With the key 185 in place, the weight is defined. The weight is connected to the pulley 162 via cable 188. Rods 190 also go through the weights and connected to top bar 132 of system 130 for stability.

The axle 160 and the pulley 162 operate as a coupling mechanism for coupling the weight system 180 to the wheel mechanism 110. The outer 112 and the inner 114 wheel portions are arranged to enable a user to comfortably grasp or grip the outer wheel portion, the inner wheel portion, or both, and turn the outer and/or inner wheel portions in a first or a second circumferential direction against a respective force or weight defined by the weight system 180, according to the inventive principles.

Figure 2:
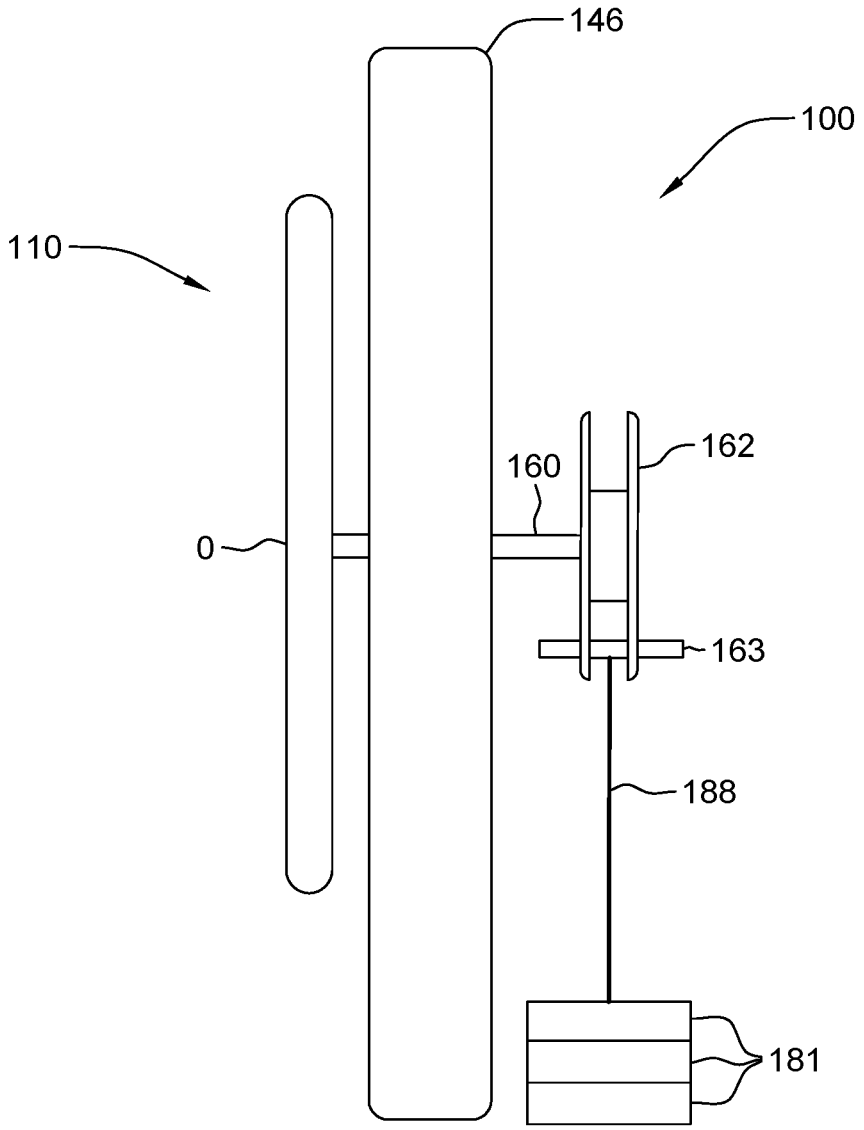
FIG. 2 presents a functional representation of the inventive system for exercising a body's oblique muscle group, according to the inventive principles.
Figure 3:
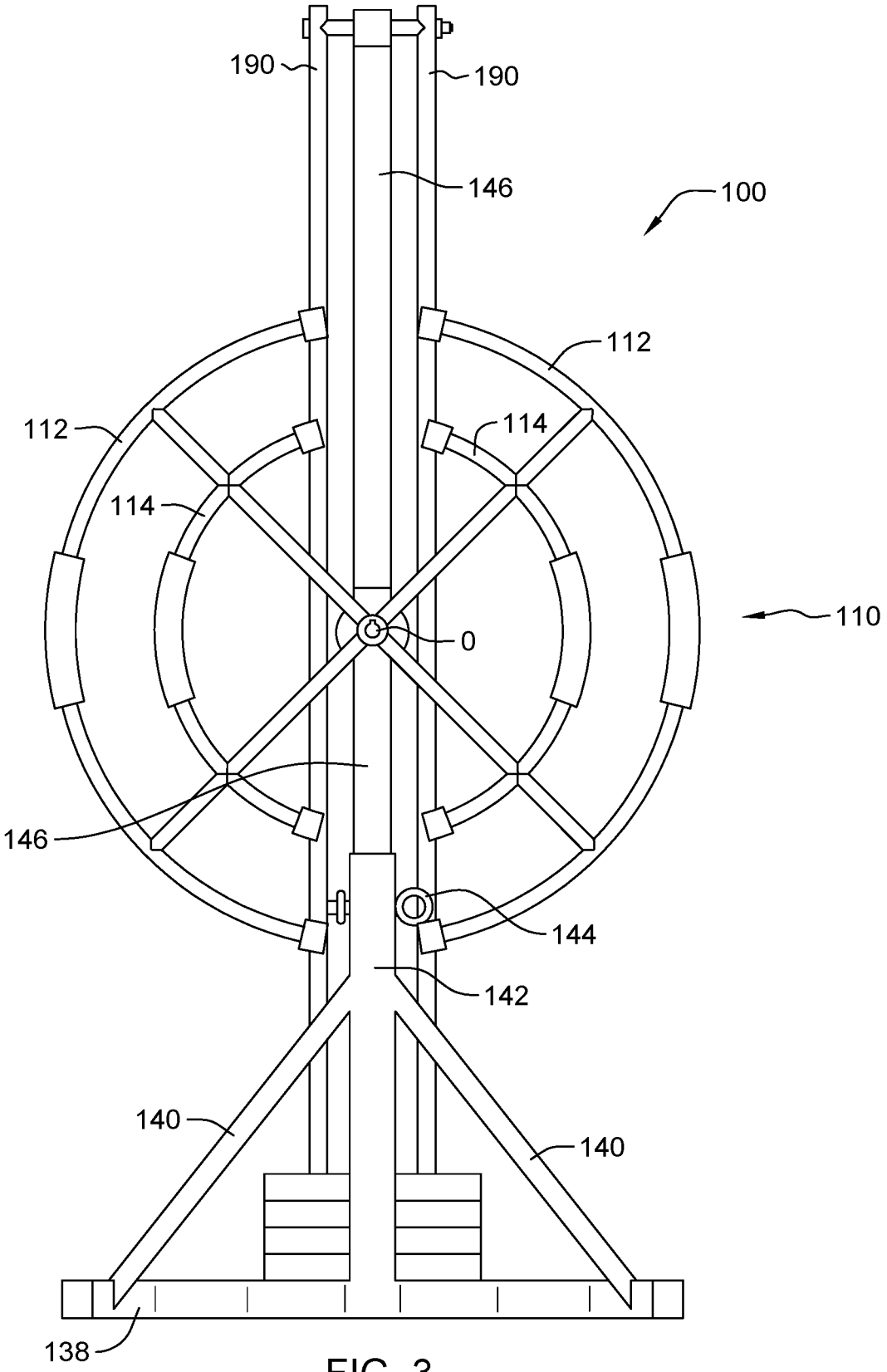
FIG. 3 presents a frontal plan view of an alternative embodiment of an inventive exercise system depicted in FIG. 1.
Figure 4A:
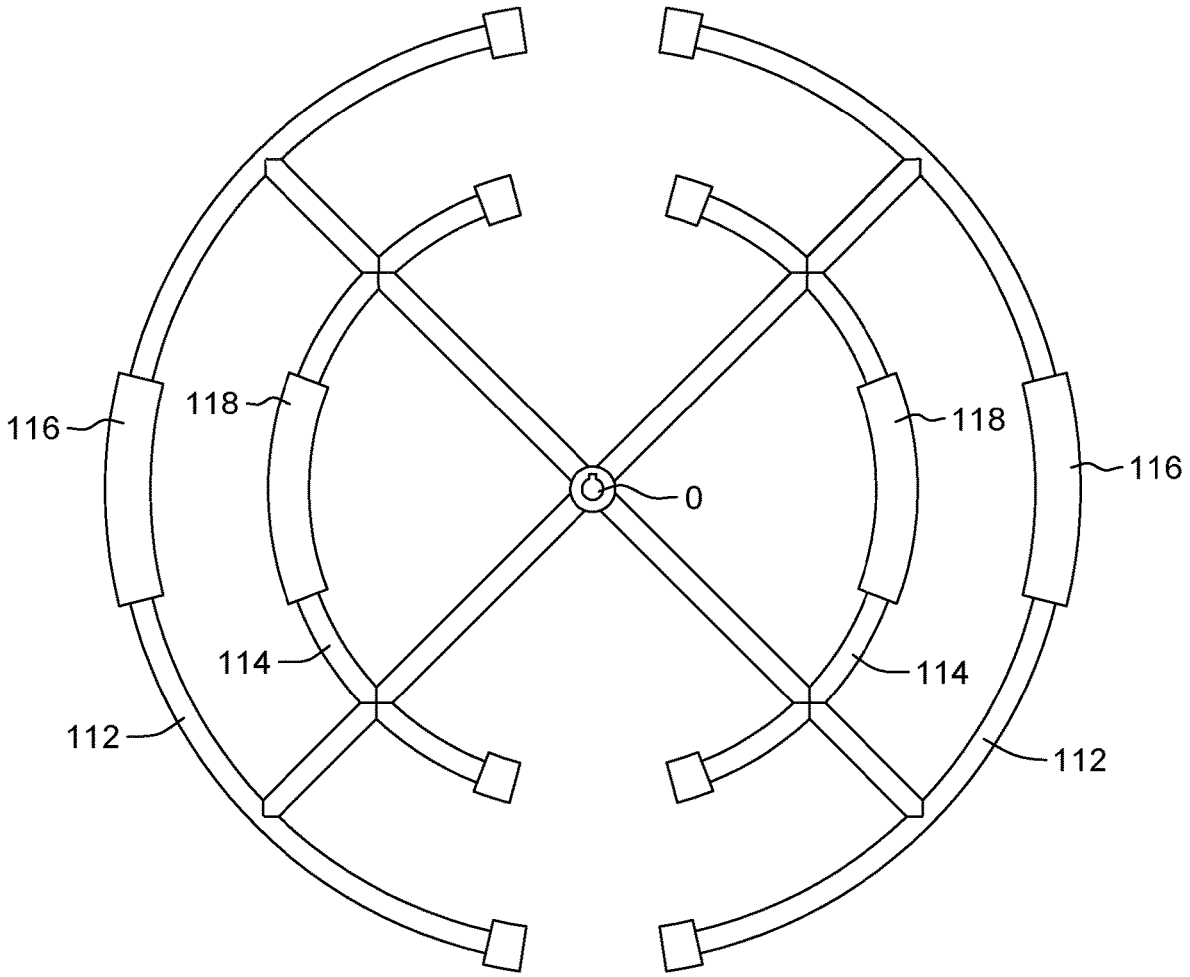
FIG. 4A presents one embodiment of a wheel mechanism that is utilized as part of the inventive system.
Figure 4B:
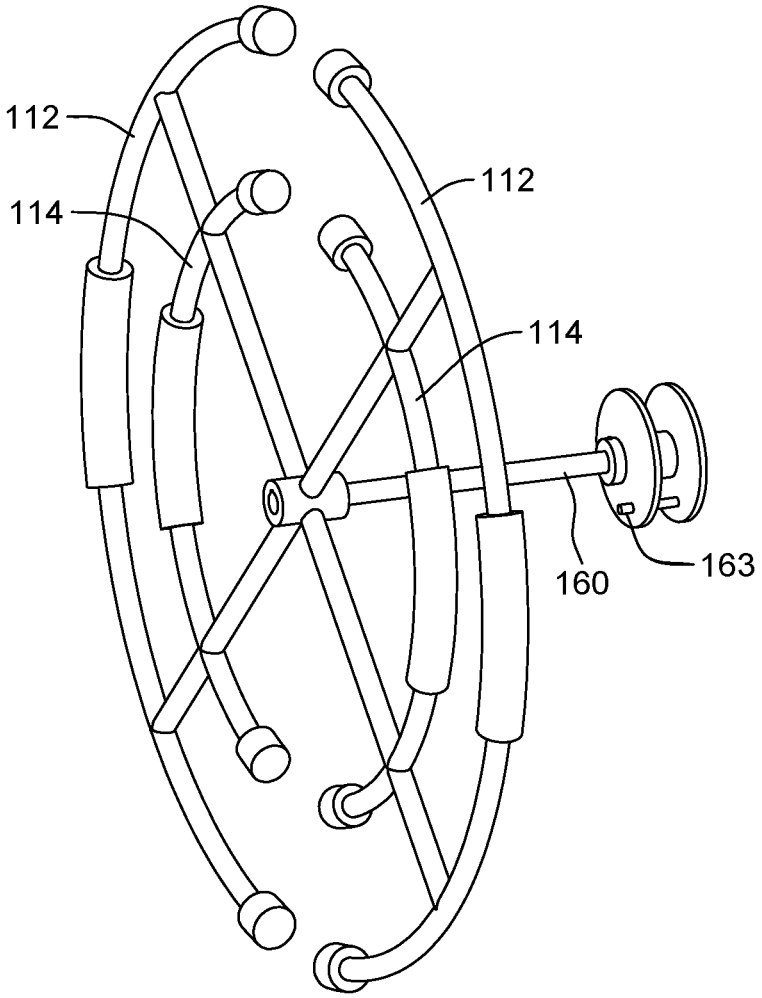
FIG. 4B presents another embodiment of a wheel mechanism that is utilized as part of the inventive system.
Figure 4C:
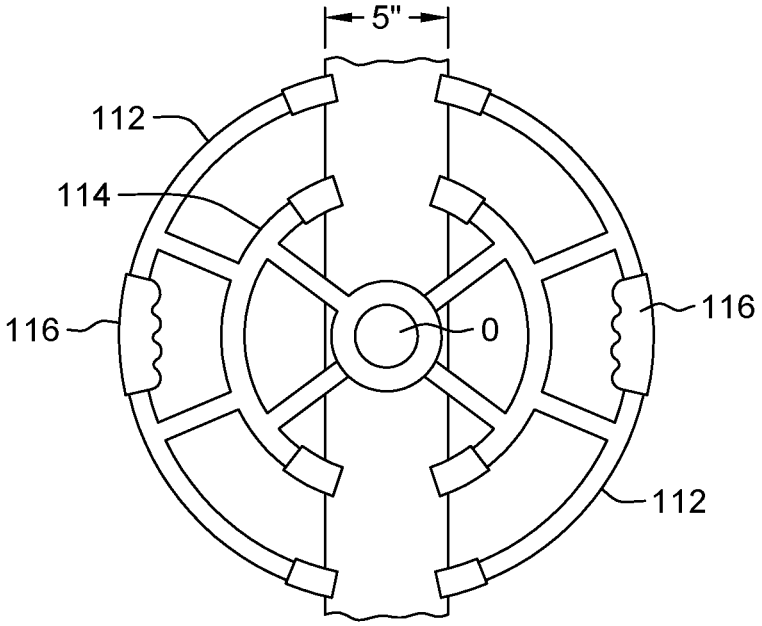
FIG. 4C presents front view of another embodiment of a wheel mechanism that is utilized as part of the inventive system.
Figure 4D:
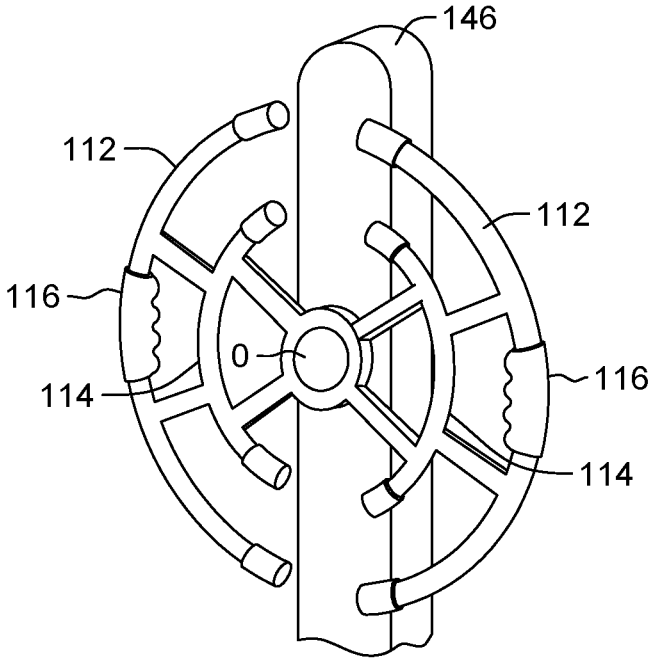
FIG. 4D presents an isometric view of another embodiment of a wheel mechanism that is utilized as part of the inventive system.

FIG. 2 presents a functional representation of the inventive system 100' for exercising a body's oblique muscle group, according to the inventive principles, where FIG. 3 presents a frontal plan view of an alternative embodiment of an inventive exercise system constructed according to the inventive principles. FIGS. 4A. 4B, 4C and 4D present embodiments of wheel mechanisms that can be utilized as part of the inventive system.

Please note that as shown, the wheel mechanisms may include at least one hand grip, such at least one hand grip 116 arranged on outer wheel 112 and/or at least one hand grip 118 arranged on inner wheel 114. Preferably, two handgrips are provided on the outer wheel and 2 handgrips are provided on the inner wheel 116.

The weight system is configured to enable a user to set a weight to define the weight or force against which the wheel mechanism is turned. To that end, the weight system includes multiple weight elements 182, and a selection mechanism 144, including a central separator 186 and key 185, for selecting a subset of weight elements 181, thereby setting the weight or force that the user must overcome when exercising his/her oblique muscle group using the inventive system.

The coupling mechanism, in one form, comprises a cable 188, a pulley 152 on an axle 160 and a quick detach pin 163 that allows a user to define one of the first and the second differential directions; the cable 188 is connected to the wheel mechanism 110. The coupling mechanism comprises any of cords, a chain, elastic bands, rubber hands, springs, a gear system and a clutch-based system to couple the wheel mechanism 110.

An amount of challenging force a user must apply to turn the wheel mechanism 110 in either the first or the second circumferential direction varies with the radial distance to a position on the inner or outer wheel portions (R1 and R2, for example), from the geometric center "0." For that matter, where an amount of challenging force a user must apply to the inner wheel portion 114 is greater than an amount of challenging force the user must apply to the outer wheel portion 112.

The wheel mechanism 110, other than the handgrips (116, 118), which are made of plastic or rubber, the weight system and the coupling mechanism are made of metal.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. An exercise system for exercising a body's oblique muscle group, comprising:

a wheel mechanism comprising a circular outer wheel portion formed by two separated arcuate members arranged at a first radial distance from a geometric center of the wheel mechanism for gripping by a user and a circular inner wheel portion formed by two separated arcuate members arranged at a second radial distance from the geometric center of the wheel mechanism for gripping by the user, where the first radial distance is greater than the second radial distance;

a weight system; and a coupling mechanism for coupling the weight system to the wheel mechanism; and wherein the circular outer and the circular inner wheel portions are configured to be grasped or gripped and turned in a first or a second circumferential direction against a respective force or weight defined by the weight system; and wherein the amount of challenging force required to turn the respective circular outer or inner wheel portions against the force or weight depends upon the radial distance to the circular inner and the outer wheel portions, from the geometric center of the wheel mechanism.

2. The exercise system of claim 1, wherein the weight system is configured to enable the user to set a weight to define the weight or force against which the wheel mechanism is turned.

3. The exercise system of claim 2, wherein the weight system includes multiple weight elements, and a selection mechanism for selecting a subset of weight elements, thereby setting the weight or force.

4. The exercise system according to claim 1, where the coupling mechanism comprises a cable, a pulley on an axle and a quick detach pin that connects the cable to the pulley.

5. The exercise system according to claim 4, wherein the cable is connected to the wheel mechanist.

6. The exercise system of claim 1, where at least one handgrip is provided on the outer wheel portion.

7. The exercise system of claim 1, where at least one handgrip is provided on the inner wheel portion.

8. The exercise system according to claim 1, where the coupling mechanism comprises any of cords, a chain, elastic bands, rubber bands, springs, a gear system and a clutch-based system.

9. The exercise system of claim 1, wherein the wheel mechanism is configured to provide an amount of challenging force to the user when the wheel mechanism is turned in either the first or the second circumferential direction.

10. The exercise system of claim 1, wherein the circular, inner wheel portion is configured to provide an amount of challenging force to the user that is greater than an amount of challenging force configured to be provided to the user by the circular outer wheel portion.

11. The exercise system of claim 1, wherein at least one handgrip is included on the inner wheel portion and at least one handgrip is included on the outer wheel portion.

12. The exercise system of claim 1, wherein the wheel mechanism, the weight system and the coupling mechanism are made of metal.

13. The exercise system of claim 1, further comprising a base or main support system upon which the wheel mechanism and weight system are arranged for support.

14. The exercise system of claim 1, wherein the circular, inner and outer wheel portions are formed as handles.

15. The exercise system of claim 1, wherein the circular, inner and outer wheel portions are arranged at radial distances R1 and R2, respectively, from the geometric center, and are radially interconnected to form inner and outer handles, separated radially by an amount equal to R2–R1.

* * * * *